United States Patent [19]

Anderson

[11] 4,081,134

[45] Mar. 28, 1978

[54] VERTICALLY ADJUSTABLE DRINKING FOUNTAIN

[76] Inventor: Henry G. Anderson, Box 21, Falls Church, Va. 22046

[21] Appl. No.: 692,249

[22] Filed: Jun. 3, 1976

[51] Int. Cl.[2] ..... E03B 9/20

[52] U.S. Cl. ..... 239/30; 222/146 C; 239/281; 239/588

[58] Field of Search ..... 239/273, 280, 280.5, 239/281, 16, 24, 28, 29, 29.3, 30, 588, 128; 62/DIG. 3, 259, 261; 248/13, 157; 312/247, 306, 312; 108/144, 146; 211/175, 207, 208; 271/154

[56] References Cited

U.S. PATENT DOCUMENTS

| | | | |
|---|---|---|---|
| 349,704 | 9/1886 | Fletcher | 239/28 X |
| 841,782 | 1/1907 | James | 239/28 X |
| 1,498,887 | 6/1924 | Pratt | 239/24 |
| 2,076,186 | 4/1937 | Reynolds et al. | 271/154 |
| 2,490,699 | 12/1949 | McCormick | 239/30 |
| 2,575,936 | 11/1951 | Andrews | 239/29.3 |
| 2,902,278 | 9/1959 | Bradshaw | 271/154 X |
| 3,286,927 | 11/1966 | Zysk | 239/281 X |
| 3,580,567 | 5/1971 | Hashimoto | 271/154 |

*Primary Examiner*—John J. Love
*Assistant Examiner*—Andres Kashnikow
*Attorney, Agent, or Firm*—Edward E. Dyson; John J. Byrne

[57] ABSTRACT

A drinking fountain which is adjustable in height to accommodate persons of different heights and persons confined to wheelchairs, thereby obviating the need for providing two separate drinking fountains of different heights.

6 Claims, 6 Drawing Figures

Fig. 1
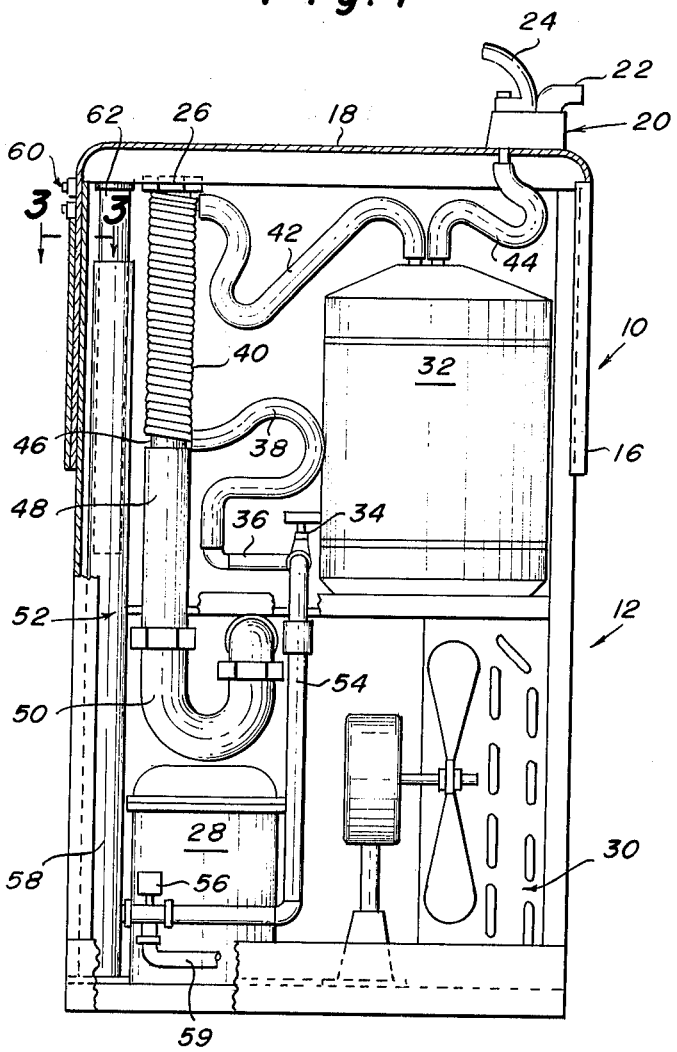
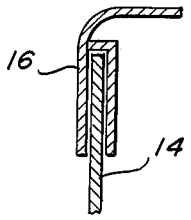
Fig. 3

Fig. 2
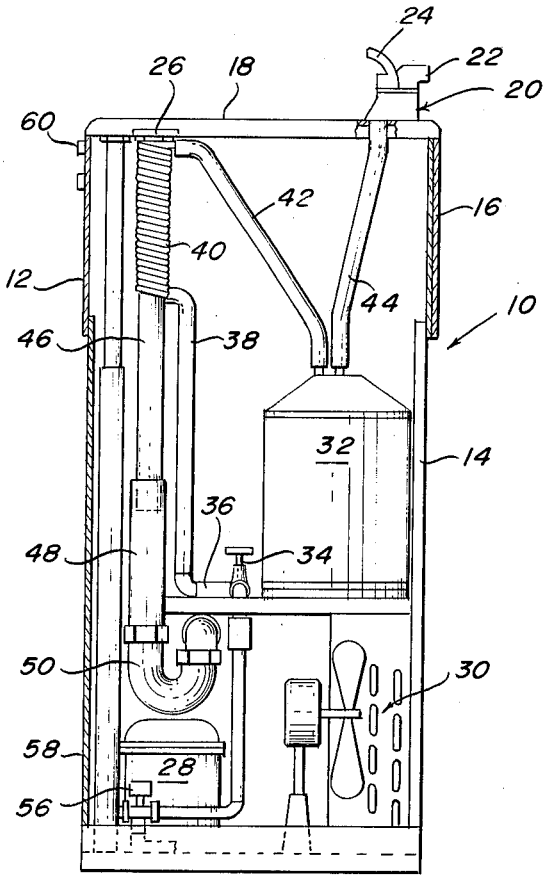
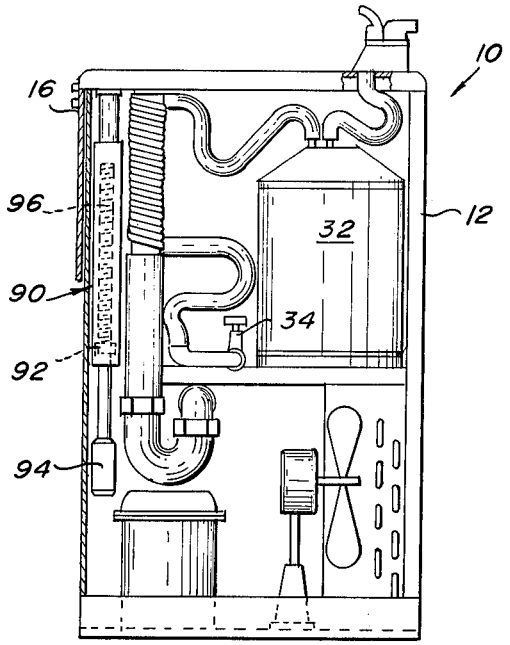
Fig. 6

VERTICALLY ADJUSTABLE DRINKING FOUNTAIN

FIELD OF THE INVENTION

This invention relates to an improvement in drinking fountains and more particularly to a drinking fountain which is adjustable in height to accommodate persons of different heights and handicapped persons confined to wheelchairs.

BACKGROUND OF THE INVENTION

Most jurisdictions have adopted building codes requiring that where a builder of an office building provides water fountains therein, he must provide, in addition to a fountain of normal height, a separate drinking fountain of a height sufficient to accommodate persons confined to wheelchairs. The purpose of this invention is to provide a vertically adjustable drinking fountain which eliminates the need for providing two separate fountains of different heights. By simply pushing a button the drinking fountain can be raised or lowered to the desired height. The provision of a single fountain capable of accommodating persons of different heights results in substantial cost savings since only one cabinet, one refrigeration unit and a single set of plumbing hardware need be employed. The cost of manufacturing such a unit is only slightly greater than that of standard units. Further, existing units can be readily converted to an adjustable unit through relative minor modifications to the cabinet structure.

At least one prior art patent, U.S. Pat. No. 1,498,887 to G. R. Pratt, dated June 24, 1924, entitled DRINKING FOUNTAIN, shows a vertically adjustable drinking fountain. However, the fountain shown therein is manually adjustable.

SUMMARY OF THE INVENTION

In a preferred embodiment of the invention, a cabinet having an upper section and a lower section houses a refrigeration unit for cooling the drinking water. The upper section has a top surface which is substantially similar to existing conventional drinking fountains and includes a drinking outlet or head, a control valve therefor and a deflector. A basin and drain are provided on the top surface. The upper section is telescopically received over the lower section and is vertically slidable relative thereto. A piston and cylinder power unit is connected between the upper section and the lower section and is actuated by water pressure from the water supply source for the drinking fountain. Upon actuation, the piston is extended to raise the upper section of the cabinet. An electrically operated valve is employed to control the water flow to the piston cylinder unit. Readily accessible electric control buttons are mounted on the exterior of the cabinet to actuate the valve and, therefore, the piston cylinder unit to adjust the height of the drinking outlet.

In another modification, a separate source of fluid pressure is provided to actuate the piston cylinder unit. Due to space considerations, such separate source, including a hydraulic oil pump and reservoir, would more than likely have to be installed in a location remote from the drinking fountain.

In a modified form of the invention, a rack and pinion drive unit, operated by means of an electric motor, raises and lowers the upper section of the housing.

In still another modified form of the invention, a worm gear drive, operated by an electric motor, is employed to raise or lower the upper section of the housing.

It is an objective of this invention to provide a drinking fountain which is readily adjustable in height to accommodate persons of different heights and handicapped persons confined to wheelchairs, thereby eliminating the need for two separate drinking fountains of different heights.

It is a further objective of this invention to provide a vertically adjustable drinking fountain which is simplistic in construction and inexpensive to manufacture.

It is a further objective of this invention to provide a mechanism for rendering drinking fountains vertically adjustable which mechanism can be readily adapted to existing units.

These and other objectives of the invention will become more apparent to those skilled in the art by reference to the following detailed description when viewed in light of the accompanying drawings.

BRIEF DESCRIPTION OF THE DRAWINGS

FIG. 1 is a side view in elevation of the drinking fountain of this invention with one wall removed to reveal the interior of the drinking fountain;

FIG. 2 is a view similar to that of FIG. 1 showing the drinking fountain in the extended position;

FIG. 3 is a cross sectional view taken on lines 3—3 of FIG. 1;

FIG. 6 is a view similar to that of FIG. 1 showing a further modified form of the drinking fountain of this invention.

Figure 5:
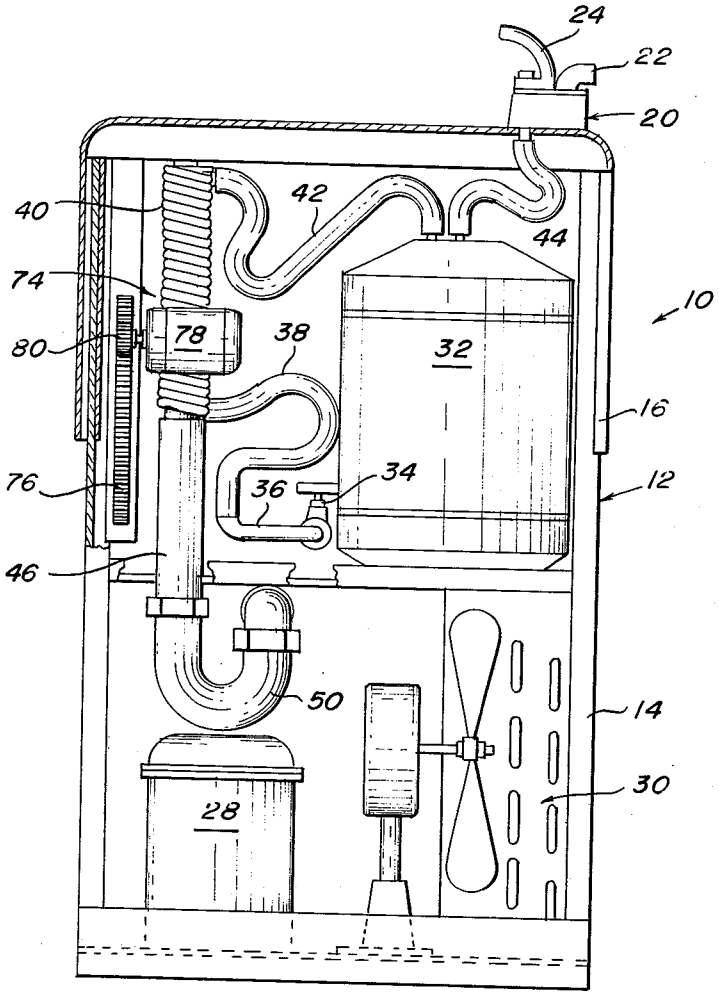
FIG. 5 is a view similar to that of FIG. 1 showing a further modified form of a drinking fountain of this invention.

Referring now to the drawings wherein like numerals indicate like parts, the drinking fountain of this invention is generally indicated by the numeral 10 and includes a housing 12 which is comprised of a lower section 14 and an upper section 16. The upper section is telescopically and slidably received over the lower section in a manner shown in FIG. 3. The upper section 16 includes a top surface 18 on which is mounted a drinking outlet that is conventional in the art and includes a flow control valve actuated by manual lever 22 and a deflector 24. The top surface 18 is also provided with a basin sloping downwardly to drain opening 26. Interiorly of the housing 12 is a refrigeration unit consisting of a compressor 28, a condensor section 30 and a refrigeration storage unit 32. The drinking fountain is connected to a suitable water supply which is controlled by shutoff valve 34. The incoming water flows through pipe 36, flexible hose 38, coil 40, and flexible hose 42 to the refrigeration storage unit 32. Another flexible hose 44 connects the storage unit 32 with the drinking outlet 20. The drain opening 26 is connected to a suitable drain pipe 46 which is telescopically received in a stationary extension 48 of the "P" trap 50. The "P" trap 50 is, of course, communicated through suitable plumbing to the waste water drainage system of the building.

As mentioned earlier, the upper section 16 of the housing 12 is telescopically received over and slidable relative to the lower section 14 of the housing. Means are provided for raising and lowering the upper section 16 relative to the bottom section to thereby raise and lower the drinking outlet 20 to accommodate persons of different heights and handicapped persons confined to wheelchairs. In the embodiment of FIG. 1, a piston and cylinder 52 is attached at one end to the stationary lower section of the housing 12 and at the other end to the movable upper section 16. The incoming water controlled by valve 34 flows not only through the refrigeration storage unit but also through line 54 and through three-way electrically controlled valve 56 to the expanisble chamber of the cylinder 58 of the piston cylinder unit 52. The valve 56 is energized by the push button control unit 60 mounted on the exterior of the cabinet to control the flow of water to and from the cylinder 58. When the valve is opened and water is introduced to the cylinder 58, the piston 62 is caused to extend thereby raising the upper section 16 of the housing 12 and the drinking outlet attached thereto. Upon actuation of the button on control unit 60 to lower the drinking outlet, the three-way valve 56 is shifted to a position such that water is exhausted from the cylinder 58 and exits via line 59 to a suitable open site drain. In this manner, the outlet is lowered. The drinking outlet can be adjusted to any position between the fully extended position and the fully retracted position. This vertical movement is substantially unimpeded because of the provision of the flexible hoses 38, 42 and 44 and the telescopic drain arrangement.

Figure 4:
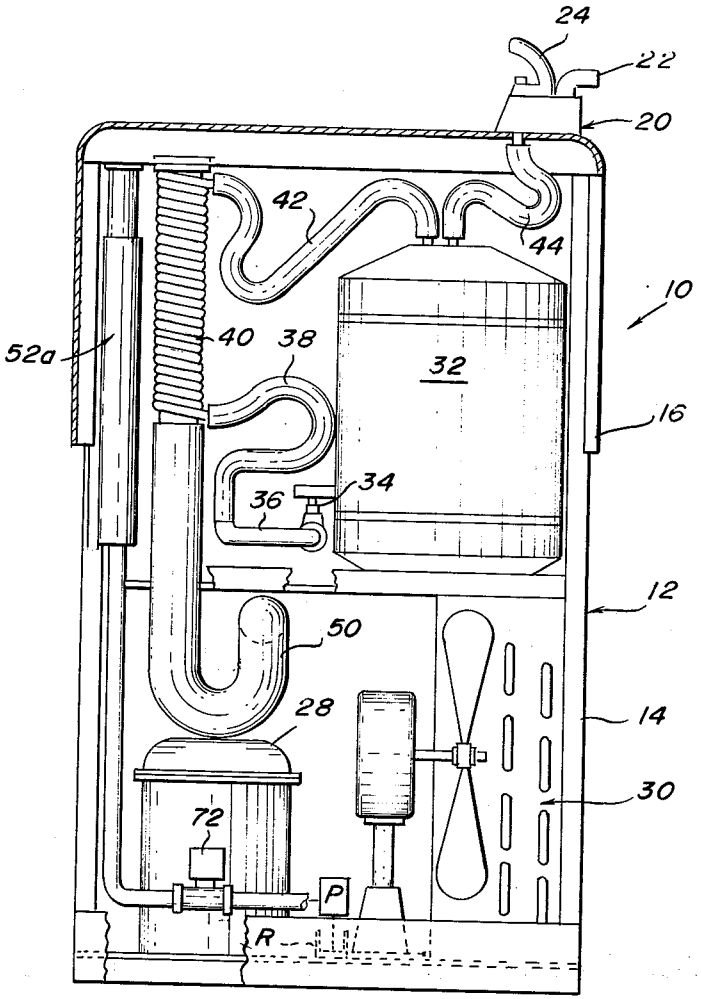
FIG. 4 is a view similar to that of FIG. 1 of a modified form of the drinking fountain of this invention.

A modified form of the drinking fountain of this invention is shown in FIG. 4. This embodiment is substantially identical to that shown in FIG. 1 except for the location of a separate fluid pressure circuit for actuating the piston and cylinder unit 52*a*. Note that the sizes of the piston-cylinder units 52 and 52*a* are different to make allowance for the difference between the normal supply water pressure and the higher pressures which can be generated in a separate fluid pressure system. In the embodiment of FIG. 4, a pump P is connected to a reservoir R on one side and to an outlet pipe 70 on the other. Electrically operated valve 72 controls the pressurization and exhaustion of the piston-cylinder unit 52*a* to effect the raising and lowering of the upper section 16. As in the embodiment of FIG. 1, suitable push button controls or the like are mounted on the exterior of the cabinet to control the valve and to energize the electric pump.

A still further embodiment is shown in FIG. 5 and includes a rack and pinion arrangement 74 for raising and lowering the upper section 16 of the cabinet 12. A rack 76 is affixed to the movable upper section 16 while the motor 78 which carries pinion 80 is mounted on a suitable stationary member not shown. When the motor 78 is energized by exteriorly mounted push buttons or the like, the pinion 80 meshes with the rack 76 to raise or lower the upper section 16 and the drinking outlet mounted thereon.

In the embodiment shown in FIG. 6, a worm gear drive unit is employed to raise and lower the upper section of the drinking fountain. More particularly, a worm gear drive unit generally indicated by the numeral 90 includes a worm gear 92 driven by an electric motor 94 which is suitably mounted in the interior of the drinking fountain cabinet 12. The worm gear 92 is drivingly engaged with an internally threaded worm gear receptor 96 which is affixed to the upper section 16 of the cabinet 12. Upon actuation of the electric motor 94 through actuation of the control buttons mounted on the exterior of the housing, the worm gear is caused to rotate and because of its threaded engagement with the receptor 96, the upper section 16 is caused to move up or down depending upon the selected direction of rotation of the motor.

In operation, the user merely pushes the control buttons on the exterior of the cabinet, which buttons are in a readily accessible location, to cause energization of the raising and lowering mechanism of any of the foregoing embodiments until the drinking outlet reaches the desired height.

In a general manner, while there has been disclosed effective and efficient embodiments of the invention, it should be well understood that the invention is not limited to such embodiments as there might be changes made in the arrangement, disposition, and form of the parts without departing from the principle of the present invention as comprehended within the scope of the accompanying claims.

I claim:

1. A drinking fountain comprising a support, a drinking outlet mounted on said support, means for communicating said outlet to a water source, said support being vertically adjustable, means for raising and lowering said support to thereby raise and lower said drinking outlet to accommodate the needs of various users, said means for raising and lowering comprising a fluid actuated piston and cylinder arrangement operably associated with said support, said piston and cylinder arrangement connected to the water source, and valve means for selectively communicating said water source to said piston and cylinder arrangement for actuation thereof.

2. The drinking fountain of claim 1 wherein said support is comprised of telescopic sections which permit said adjustment in height.

3. The drinking fountain of claim 1 wherein said support is an enclosed housing, said housing comprising an upper section and a lower section, said upper section being vertically adjustable relative to said lower section, and said drinking outlet being mounted on said upper section.

4. The drinking fountain of claim 3 and including a water cooling refrigeration unit in said housing.

5. The drinking fountain of claim 3 and including a drain opening in the upper section of said housing and a water outlet in the lower section of said housing, and a drain pipe having telescoping sections connecting said drain open to said water outlet.

6. The drinking fountain of claim 1 wherein said means for communicating said outlet to said water source includes a flexible hose to permit the raising and lowering of said outlet.

* * * * *